US008240755B2

(12) United States Patent
Valaei Khiabani

(10) Patent No.: US 8,240,755 B2
(45) Date of Patent: Aug. 14, 2012

(54) FOLDABLE TABLE

(76) Inventor: Kaveh Valaei Khiabani, North York (CA)

( * ) Notice: Subject to any disclaimer, the term of this patent is extended or adjusted under 35 U.S.C. 154(b) by 368 days.

(21) Appl. No.: 12/498,820

(22) Filed: Jul. 7, 2009

(65) Prior Publication Data

US 2010/0001557 A1 Jan. 7, 2010

(30) Foreign Application Priority Data

Jul. 7, 2008 (CA) ..... 2635597

(51) Int. Cl.
*A47B 39/00* (2006.01)

(52) U.S. Cl. ..... 297/159.1; 297/143; 108/128

(58) Field of Classification Search ..... 297/158.4, 297/159.1, 461, 462, 143; 108/115, 128, 108/145

See application file for complete search history.

(56) References Cited

U.S. PATENT DOCUMENTS

| | | | | |
|---|---|---|---|---|
| 786,732 | A | 4/1905 | Crandall | |
| 1,226,554 | A * | 5/1917 | Mante | 108/41 |
| 1,277,988 | A * | 9/1918 | Miller | 108/166 |
| 2,162,298 | A | 7/1937 | Dailey | |
| 2,445,489 | A * | 7/1948 | Mangold | 108/41 |
| 2,560,079 | A * | 7/1951 | Blum | 248/155.3 |
| 3,261,308 | A * | 7/1966 | Szymber | 108/145 |
| 4,144,823 | A | 3/1979 | Rathert | |
| 4,232,901 | A * | 11/1980 | Harrington et al. | 297/423.45 |
| 5,285,992 | A * | 2/1994 | Brown | 248/421 |
| 5,425,315 | A | 6/1995 | Huggins | |
| 6,065,802 | A | 5/2000 | Bue | |

* cited by examiner

*Primary Examiner* — Peter R. Brown

(57) ABSTRACT

A folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior, wherein operation of the jack permits the folding and unfolding of the table.

17 Claims, 15 Drawing Sheets

FOLDABLE TABLE

FIELD OF THE INVENTION

The present invention relates to a jack operated foldable table comprising a table assembly and an optional seat assembly.

BACKGROUND OF THE INVENTION

Foldable furniture is well known in the art specifically chairs and tables. Foldable tables present two essential benefits, they occupy little space during the storage and can accommodate several people in the unfolded operating state. There are many families which does not require large table surfaces on a daily basis. However from time to time they need to accommodate larger numbers of guests. For them having a foldable table and chairs is one solution. Further in the current real estate market with more and more people living in condominiums with small apartments, modular foldable furniture becomes desirable.

There are number of collapsible tables and collapsible dining sets described in prior art.

U.S. Pat. No. 6,065,802 discloses a folding table and a seating apparatus comprising a circular table and eight stools. This assembly, even in a folded state, occupies a large space and does not provide a sufficient solution to space limitations in condominiums.

There are several "umbrella type" foldable tables as disclosed in U.S. Pat. Nos. 786,732; 2,162,298 and 5,425,315. These tables which occupy a small space are disadvantageous in that, when collapsed, the upper table surface folds outward and remains open to air subjected to dust and dirt. This is undesirable due to sanitary concerns.

Further U.S. Pat. No. 4,144,823 discloses a collapsible table and a seat assembly in which the table top is stored inside the interior of the housing. The described design has a limitation in the size of the table which can be nested inside the interior. Further there some operational limitations: the folding and the unfolding of the table are complicated and physically challenging. Finally this type of assembly is adapted to be used mostly outdoors and is not suitable for the indoor use.

There were numerous attempts to develop foldable tables with a seat assembly, however most of those tables had various deficiencies. Some expose the table tops to the environment making it a sanitary concerns. Others have a complicated mechanical structure while others occupied a lot of storage space.

Another deficiency of the foldable tables described in the prior art was the folding and unfolding operation. All the tables had to be manually operated and therefore the procedure of folding and unfolding required physical strain and limited the manufacturing of tables to a smaller size.

It is therefore a primary object of the invention to provide a foldable table operable by a jack to make the folding and unfolding of the table effortless.

It is yet another object of the invention to provide a foldable table which does not expose its working surface to the environment during the storage in the folded state.

It is another object of the invention to provide a foldable table with a lid which serves as a lid in the folded state and as a serving surface in the operational state.

It is yet a further object of the invention to provide a foldable table with a foldable seat assembly operable by a jack.

Thus the present invention relates to a foldable table and a seat assembly which overcomes the deficiencies of the prior art. The present invention is directed to an improved foldable table which is easy to store and easy to operate, the table is not limited in size and does not expose the table top to the environment during storage.

Further and other objects of the invention will become apparent to those skilled in the art when considering the following summery of the invention and the more detailed description of the preferred embodiments illustrated herein.

SUMMARY OF THE INVENTION

According to the present invention, an improved foldable table that opens and folds into the table base by a hydraulic jack is provided.

The folding table assembly comprises a table base, a foldable table top and a jack assembly which folds the table top into the table base for storage purposes and pushes out the table top from the table base for its operative state. The folding table assembly further comprises a lid which is placed on the rim of the table base when the foldable table top is folded and is used as a table top of the small column table. When the table top is unfolded, this lid turns into a "Lazy Susan" in the centre of the table.

The table base comprises a bottom and a hollow pillar opening at the top. This table base houses a jack assembly attached to the bottom and contains the foldable table top in the folded position. The table base further supports the foldable table top in its unfolded position.

The term "jack" used through this application for clarity, refers to any lifting/lowering device known to the person skilled in the art and includes: mechanical, electrical, hydraulic, pneumatic and other lifting/lowering devices.

The jack assembly may comprise a jack with extended lifting legs, these legs have sufficient extension range to push out the foldable table top from the interior of the table base. This assembly further comprises a telescopic stand attached to the bottom of the base and the jack and the bottom of a lifting portion of the foldable table top. This telescopic stand prevents radial movement of the table top during the lifting operation of the jack. The jack assembly further comprises an electrical circuit, comprising a power supply, a transformer and an operation input which can be locally or remotely controlled.

During storage, the jack assembly and the foldable table top are contained inside the hollow table base, while the lid is placed on the rims of the table base. In order to unfold the table for its fully opened operating state, the user removes the lid, and initiates the jack with a local or remote controller. The jack assembly extends vertically, pushing the lifting portion upward. The lifting portion pushes the folding table top outward from the table base and as soon as the upper arms with the top table members are released from the table base, the members unfold outwardly providing a table surface which is substantially parallel to the ground and substantially perpendicular to the table base. The lower arms remains inside the limitations of the table base at all times preventing the over extension of the upper arms. Thus the upper arms are lying on the rims of the table base restrained by the lower arms. Finally, the user places the lid in the centre of the open table covering the perimeter of the table base with the lower arms and providing the central piece of the table.

When the fully open table is not further necessary, it may be folded in the same manner. The user first removes the lid from the center of the table assembly, then operates the jack assembly which pulls the lifting portion downward, and pulls the lower and upper arms into the interior of the table base and consequently the foldable table top is stored in the interior of the table base. Finally the user covers the table base with the lid and may use this column as a coffee table or any other supporting or decorative furniture.

An object of this invention is to provide a foldable table which is easy to operate, which does not require physical strength and can be operated with a push of a button. Further this table can be manufactured in sizes larger then the comparable folding tables and can also be used indoors. Such tables can be used in various locations such as condominiums, residential buildings, restaurants, cafés, hotels, hospitals, federal buildings and other public areas where there is a concern for space and sanitary issues are important.

According to primary aspect of the invention there is provided a folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior, wherein operation of the jack permits the folding and unfolding of the table.

According to yet another aspect of the invention there is provided a folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior. Further the operation of the jack permits the folding and unfolding of the table, wherein said jack is preferably a scissors jack preferably electrical and capable of moving upward and downward preferably with a local or remote control to move said folding table between the folded and unfolded positions. The folding table in the assembly is substantially round at the unfolded position, and further comprising the following parts:

a lifting portion engaged with the jack, a plurality of lower arms, each arm having a first end and a second end, the first end of each lower arm being attached to the lifting portion allowing the lower arm to move substantially vertically, a plurality of upper arms in association with said plurality of lower arms, each upper arm having a first end and a second end, the first end of the upper arm being connected to the second end of the lower arm and is able to move substantially vertically, the outer hinges connecting the second ends of the outer arms and capable of movement at the connection points, the inner hinges connecting the second ends of the lower arms and capable of movement at the connection points; and table top members extending between the outer hinge, the inner hinge and the two respective adjacent upper arms, thus forming a table top at the unfolded position.

According to yet another aspect of the invention there is provided a folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior. Further the operation of the jack permits the folding and unfolding of the table, wherein said jack is preferably a scissors jack preferably electrical and capable of moving upward and downward preferably with a local or remote control to move said folding table between the folded and unfolded positions. The folding table in the assembly is substantially round at the unfolded position, and further comprising the following parts:

a lifting portion engaged with the jack, a plurality of lower arms, each arm having a first end and a second end, the first end of each lower arm being attached to the lifting portion allowing the lower arm to move substantially vertically, a plurality of upper arms in association with said plurality of lower arms, each upper arm having a first end and a second end, the first end of the upper arm being connected to the second end of the lower arm and is able to move substantially vertically, the outer hinges connecting the second ends of the outer arms and capable of movement at the connection points, the inner hinges connecting the second ends of the lower arms and capable of movement at the connection points; and table top members extending between the outer hinge, the inner hinge and the two respective adjacent upper arms, thus forming a table top at the unfolded position. The folding table assembly further comprises a folding seat moveable between a folded and an unfolded position and at least partially operable by the operation of the jack. The folding seat comprising:

a beam, a post for supporting the beam at a substantially horizontal position, and a seating member extending between adjacent beams of the foldable seat assembly at the fully open position. Wherein at the folded position the post is folded toward the beam and the beam being moved by the jack toward the wall of the base and thereat locking the beam and the post in the position preferably parallel to the wall.

Preferably the jack is a scissors jack preferably electrical and capable of moving upward and downward preferably with a local or remote control to move said folding table between the folded and unfolded positions.

Preferably the folding table folds in upon itself in a fan like orientation, wherein operation of the jack permits the folding and the unfolding of the table.

The beam of the folding seat preferably further comprises a container which contains the support member in a biased state.

Further preferably each beam and a seating member comprises an interlocking member which engage and disengage when the folding seat is moved between the folded and unfolded positions.

In yet another aspect of the invention the foldable table assembly further comprises a lid suitable for covering the wall and the hollow interior of the base. Preferably the lifting portion comprises a rod member and the lid is suitable to rotate on top of the rod member in the operational mode of the assembly.

A further embodiment of the invention comprises a foldable seat assembly attached to the table base. In this embodiment there are vertical slots in the table base where the seat assemblies are connected through those slots to the lifting portion. Each seat assembly has a foot, a leg, a knee joint, and a hip with a rolling out seat member. The hip is further attached to a hip joint while the hip joint is attached to the rib which is connected to the lifting portion.

In the operating state there is a right angle between the leg and the hip while the leg is substantially parallel to the table base and extending away from the table base. The hip is substantially perpendicular to the table base and extends between the leg and the table base. The knee joint further has a safety pin which allows locking of the hip relatively perpendicular to the leg and prevents its accidental folding.

Once the hips and legs are unfolded, the user can then stretch fabric from the seat tubes located on the hips and attach its locks to the corresponding attachments on the corresponding hip.

Other objects, features and advantages of the present invention will become apparent from the following detailed description when read in conjunction with the drawings and appended claims.

DETAILED DESCRIPTION OF THE PREFERRED EMBODIMENTS

In order to clarify the drawings, the list of the parts with the corresponding reference numbers are provided below.

| # | Description |
|---|---|
| 1 | Table top/Folding table |
| 2 | Table base |
| 3 | Seat assembly/Folding seat assembly |
| 10 | Folding table assembly |
| 11 | Base |
| 12 | Hollow pillar/Wall |
| 13 | Jack |
| 14 | Telescopic stand |
| 15 | Lifting legs |
| 16 | Power cord |
| 18 | Actuator |
| 19 | Rim |
| 20 | Lifting portion |
| 21 | Shoulder joint |
| 22 | Lower arm |
| 23 | Elbow joint |
| 24 | Inner hinge |
| 24a | Pate of the inner hinge |

-continued

| # | Description |
|---|---|
| 24b | Pate of the inner hinge |
| 24c | Pate of the inner hinge |
| 25 | Upper arm |
| 26 | Hinge joint |
| 27 | Outer hinge |
| 28 | Top plate |
| 29 | Restricting pin |
| 29a | Restricting pin |
| 29b | Restricting pin |
| 30 | Lid |
| 31 | Plate support |
| 32 | Rod |
| 33 | Socket |
| 34 | Screw |
| 34a | Screw position |
| 34b | Screw position |
| 35 | First end of the lower arm |
| 36 | Second end of the lower arm |
| 37 | First end of the upper arm |
| 38 | Second end of the upper arm |
| 40 | Seat assembly |
| 41 | Rib |
| 42 | Hip joint |
| 43 | Hip/Beam |
| 44 | Seat tube/Container |
| 45 | Knee joint |
| 46 | Leg/Post |
| 47 | Foot |
| 48 | Loop/Interlocking member |
| 49 | Hook/Interlocking member |
| 50 | Seat/Seating member |
| 51 | Sliding slot |
| 52 | Profile |
| 53 | Top and bottom of the profile |
| 54 | Limiting pin |
| 55 | Spring pin |

Figure 1:
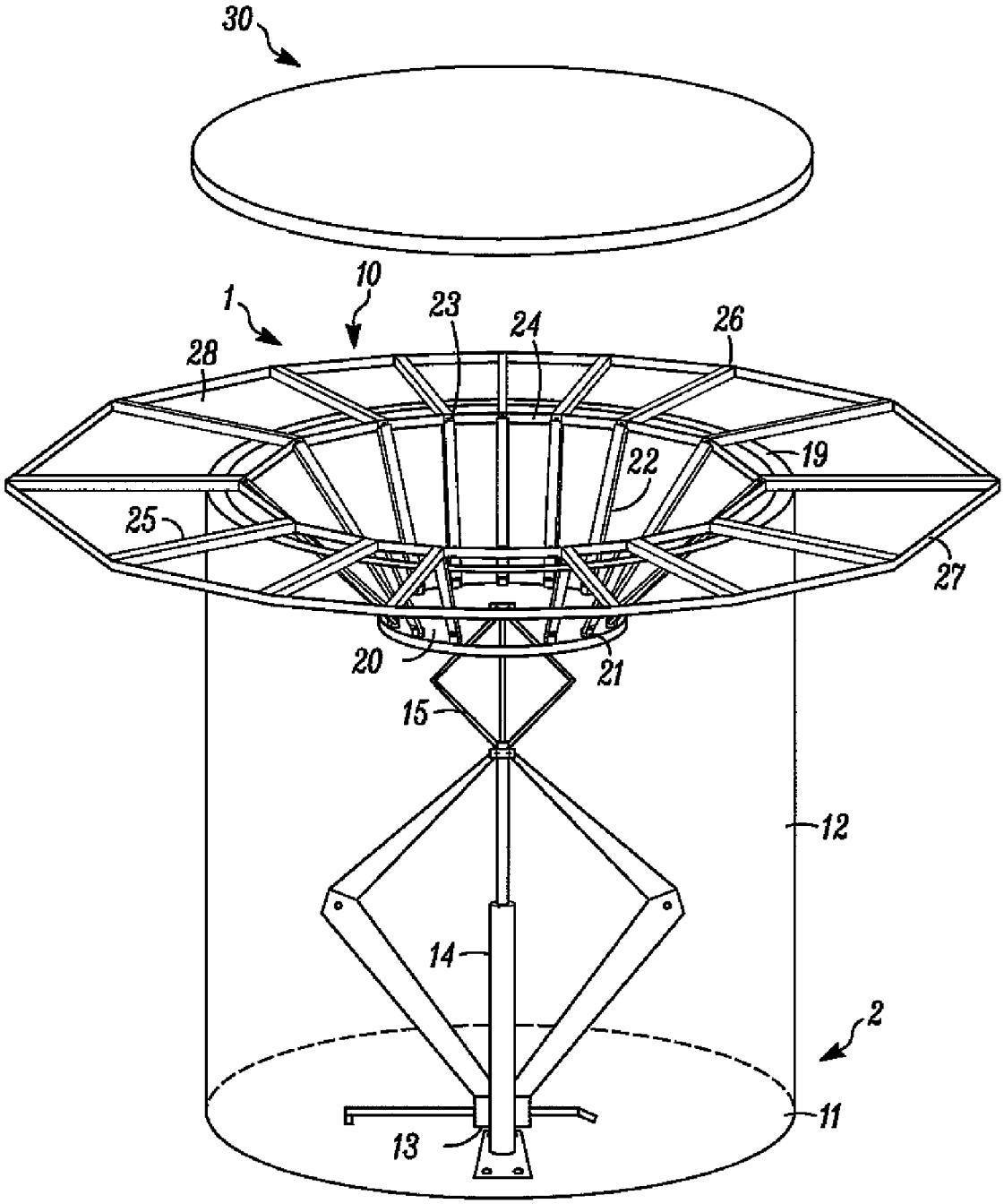
FIG. 1 is a side view of the foldable table in its fully open position.
Figure 4:
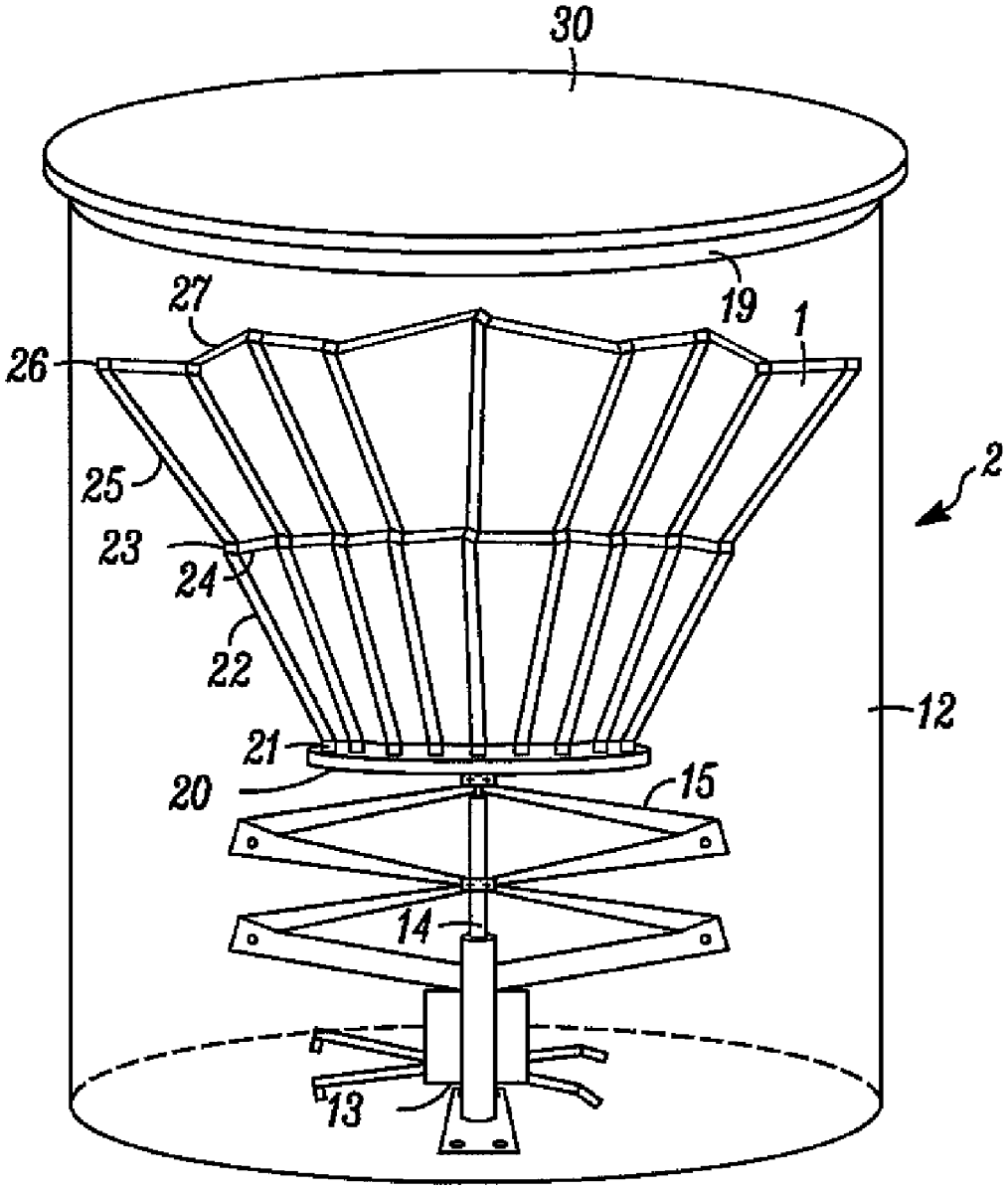
FIG. 4 is a side view of the foldable table in its fully folded position.

The folding table assembly is best depicted in FIG. 1 and FIG. 4 and is illustrated in its fully opened position in FIG. 1 and fully closed position in FIG. 4. The folding table assembly has three main units: a table top 1, a table base 2 and a jack unit 13. The table base 2 comprises a wall surrounding a hollow interior such as a hollow pillar 12 which accommodates the table top 1 in its fully folded position and which supports the table top 1 on a rim 19 in its fully opened position. The hollow pillar is located on the base 11 which serves as the bottom of the table. The table base may be manufactured from various types of materials such as wood, plastics, polymers and metals. Inside the hollow pillar 12 in the center of the base 11, the jack unit 13 is located. The jack unit 13 is the main operational unit of the folding table assembly 10. The jack unit 13 lifts the folding table top 1 from the interior of the table base during its operation phase and folds the folding table top 1 into the table base for storage. The jack 13 is an electrical 12 volt jack which may be operated by a local controller or by a remote control. These lifting jacks are well known in the prior art and are readily available on the market from different manufacturers. The jack unit 13 has all the electrical wiring and controllers necessary for the operation of the folding table. A transformer if needed is also located in the proximity of the jack 13 on the base 11 inside the hollow pillar 12 of the table base 2. Since the original jacks offered on the market have a limited elevation a set of lifting legs 15 are attached to the jack 13 in order to increase its elevation range. The lifting legs 15 are attached to the original lifting legs of the jack and works in a similar scissor mode as the original legs of the jack, this way extending the elevation range of the jack to operate in the range of the folding table assembly. The jack unit 13 further comprises a telescopic stand 14 attached to the jack's lifting legs and also attached to the center of the lifting portion 20 which is the base to the table top 1. Besides the 12 volt jacks readily available on the market, any other type of jack can be utilized for the same function.

The table top 1 comprises a lifting portion 20 which has on its perimeter a plurality of joints 21 and from those joints there are lower arms extending away from the center of the plate. Those lower arms are terminating by the elbow joints which are attached to the upper arms 25 and the inner hinges 24. The upper arms 25 further extend away from the center of the table top 1 and terminate at the hinge joints 26 attached to the outer hinge 27. All the parts of table top 1 may be manufactured from various materials suitable for the purpose of the table. These materials may be plastics, polymers and metals preferably metals such as aluminum. As illustrated in FIG. 1 in its fully extended and fully opened position the table top 1 is supported by the rim 19 of the hollow pillar 12 and the outer hinge 27 extending away from the hollow pillar 12. In the fully closed position as illustrated in FIG. 4 the lifting legs of the jack unit 13 are folded inward to the hollow pillar and pulling with them the lifting portion 20 which pulls the lower and upper arms into the interior of the hollow pillar as well. The top of the table base 2 is then covered with the lid 30.

Figure 2:
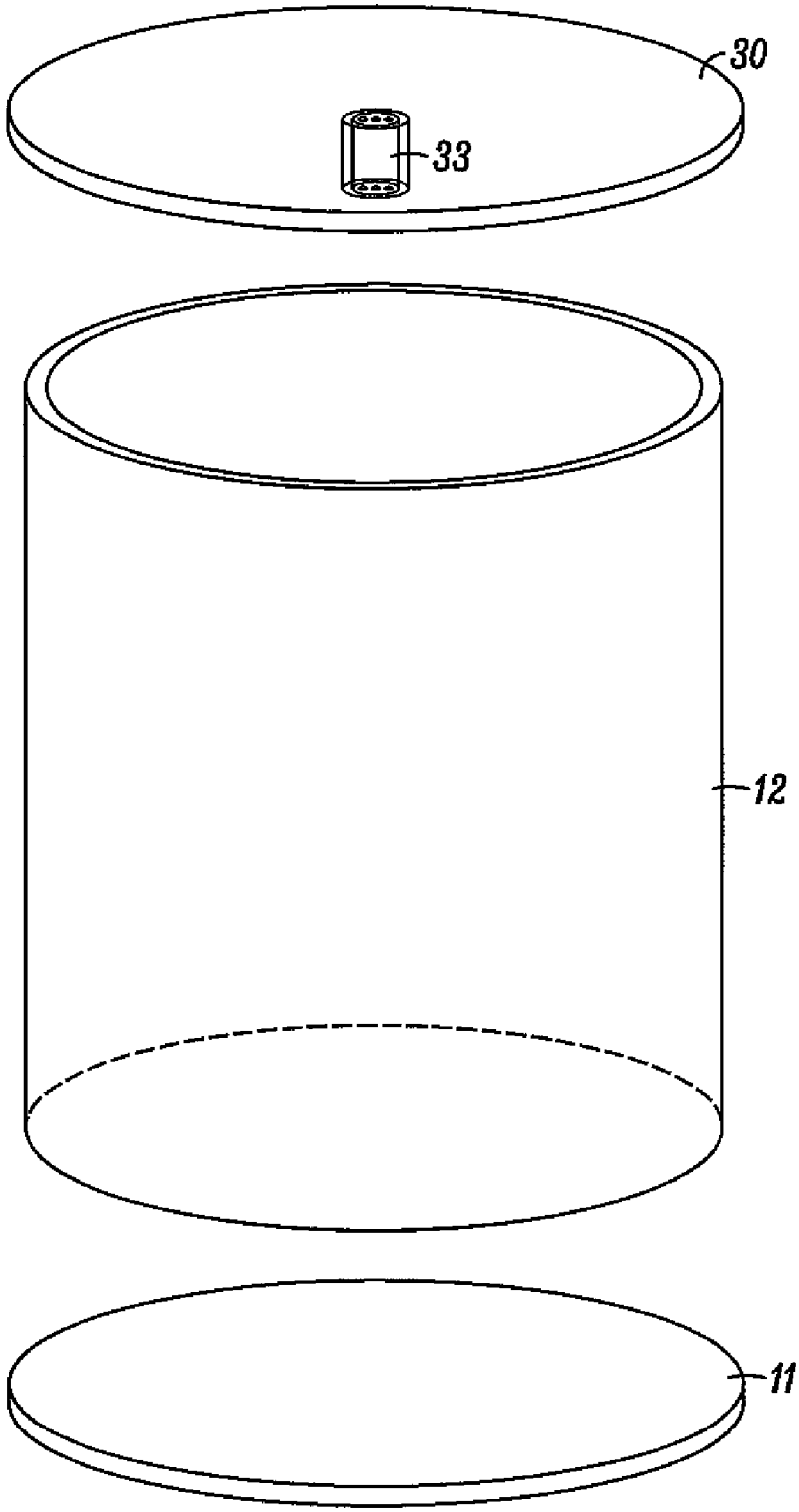
FIG. 2 is an exploded view of the table base with the table lid.

Now referring to FIG. 2, the table base is illustrated in its extended position and the table base comprising the base board 11, a hollow pillar 12 and a lid 30. The lid 30 is designed to cover the interior of the hollow pillar 12 in the fully closed position. Further in the fully operational position the lid 30 covers the center of the table top 1. In a preferred embodiment the lid 30 may be used as a "Lazy Susan" in the fully opened position. The lid 30 is equipped with socket 33 fitting with the rod 32 best seen in FIG. 10. The lid 30 can then freely rotate on the rod 32 in the fully operational position of the table assembly 10. There are many known techniques for manufacturing a "Lazy Susan" lid which can be used for this assembly. However, for the simplicity, the lid 30 can also be stationary.

Figure 3:
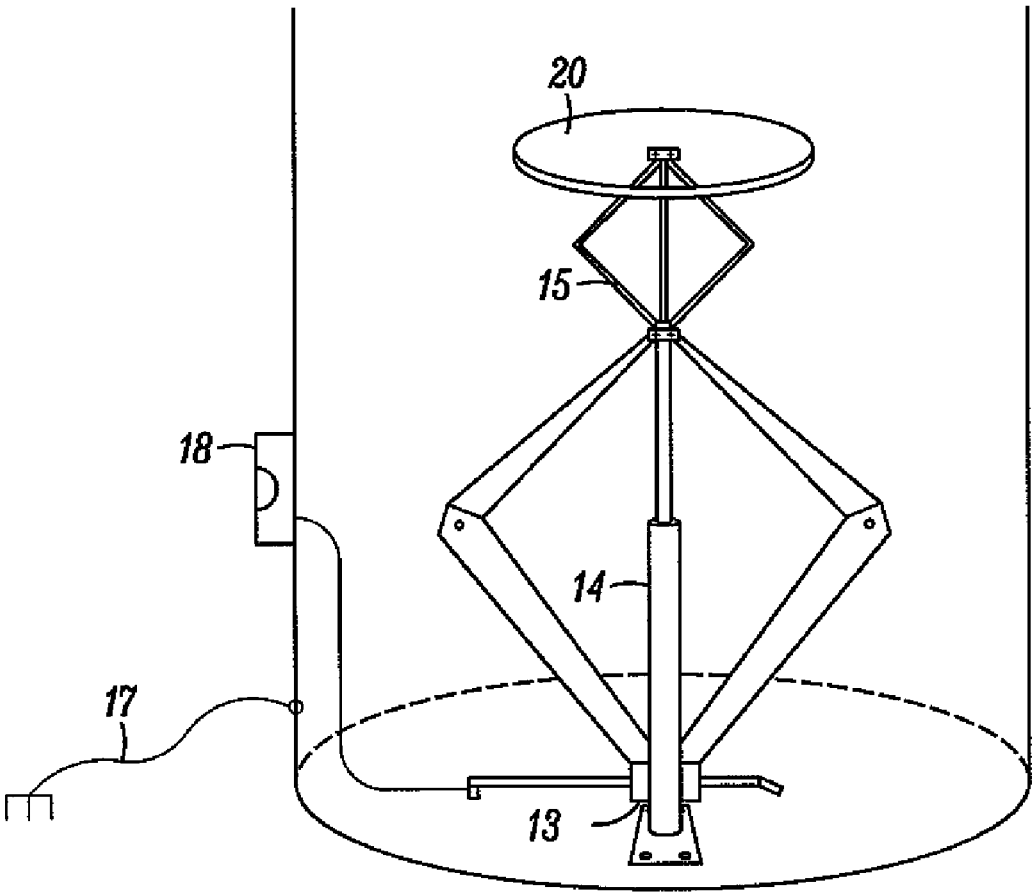
FIG. 3 is a side view of the jack with the extended lifting legs.

Referring now to FIG. 3 which illustrates the jack unit 13 in its fully extended position with the extended lifting legs 15 and a fully extended telescopic stand 14. The jack unit 13 which was previously disclosed is an electric operated jack which may be of any type available on the market while its arms might be extended with the lifting legs 15. The jack unit 13 may be operated manually by an actuator 18 or remotely by an actuator which is not shown in this figure while the receiver may be attached to the body of said jack, also not shown in this figure. The jack unit 13 has an electrical power cord extending outwardly from the table base 2 for the connection to the electricity grid. If required, a transformer can be placed inside the hollow pillar 12 of the table base 2. The electric sockets are not shown in FIG. 3 but its operation would be apparent to one skilled in the art.

Referring now to FIG. 4 the table is illustrated in its fully folded position while the pillar illustrated here is transparent only for ease of the view of the fully folded table. As illustrated in FIG. 4, the movement of the jack unit 13 downward pulls the table top assembly 1 into the hollow pillar 12 and then lid 30 covers the top of the hollow pillar by lying on the rim 19. In order to unfold the table assembly into its fully operating position the lid 30 has to be removed from the top of the table base. The jack unit 13 is actuated by a remote or local control and pushes the lifting portion 20 upwards extending the table top outwardly from the hollow pillar 12 and then unfolding the table top above the table base.

Figure 5:
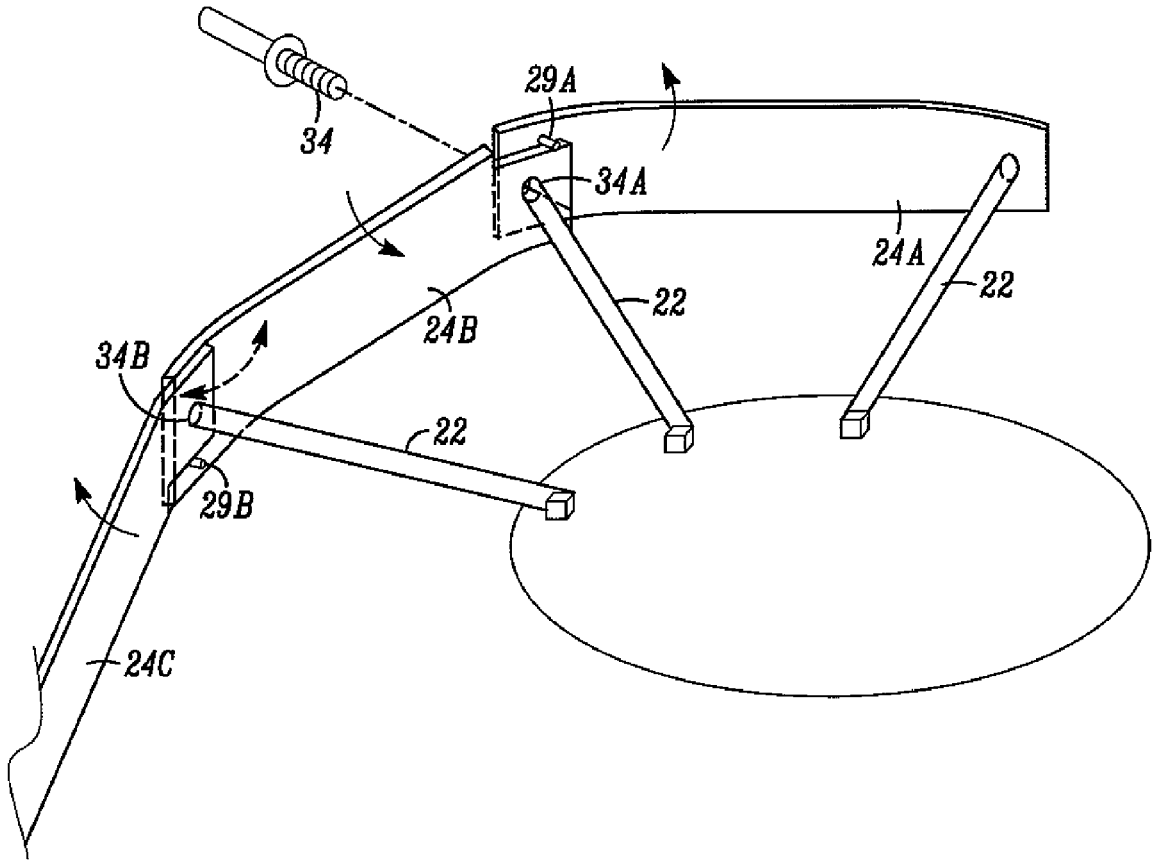
FIG. 5 is a partial view of the inner hinge.
Figure 6:
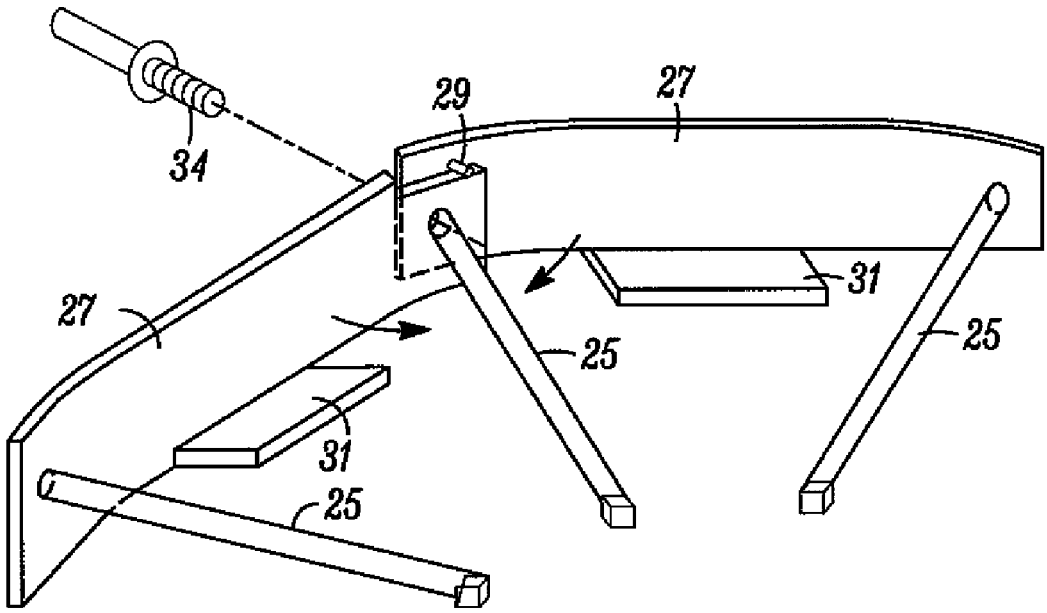
FIG. 6 is a partial view of the outer hinge.

Referring now to FIGS. 5 and 6 the outer and the inner hinges are illustrated. The outer and the inner hinges each comprise a thin, elongated plate attached to an upper arm with a screw 34 while this plate may move around the screw 34 in clockwise or counterclockwise way. The path of the motion is limited by a small pin 29. As illustrated in FIG. 5, in the folding motion when the lower arm 22 pulls the screw 34 toward the interior of the table base the folding process of the inner hinge starts and the plate 24*a* rotates counterclockwise relatively to the screw 34 and with this motion the pin 29*a* forces the right side of plate 24*b* to rotate clockwise relatively to the screw 34*a* while the left part of the plate 24*b* rotates clockwise relatively to the screw 34*b* and the pin 29*b* causes the plate 24*c* to rotate counterclockwise relatively to the screw 34*b*. As a result all plates of the inner hinge folds in a fan like motion due to the movement of the jack downward into the table base. Similar folding motion occurs for the outer hinge 27 as illustrated in FIG. 6.

The ends of the plates are perpendicular to the arms which they are connected to. The joint of the plates are bent in an angle relatively to the body of the plate. This angle is affected accordingly to the number of plates in the table top. The strategic position of pin 29 allows the plates to move only in one direction during the folding motion and in the opposite direction during the unfolding motion of the table top. Further, the outer hinge plates and the inner hinge plates include top plate supports. Those plate supports are supporting the top plate of the table top creating the upper surface of the table. The table top plate can be glued, screwed, welded or attached to the plate support in any manner known in the art.

Figure 7:
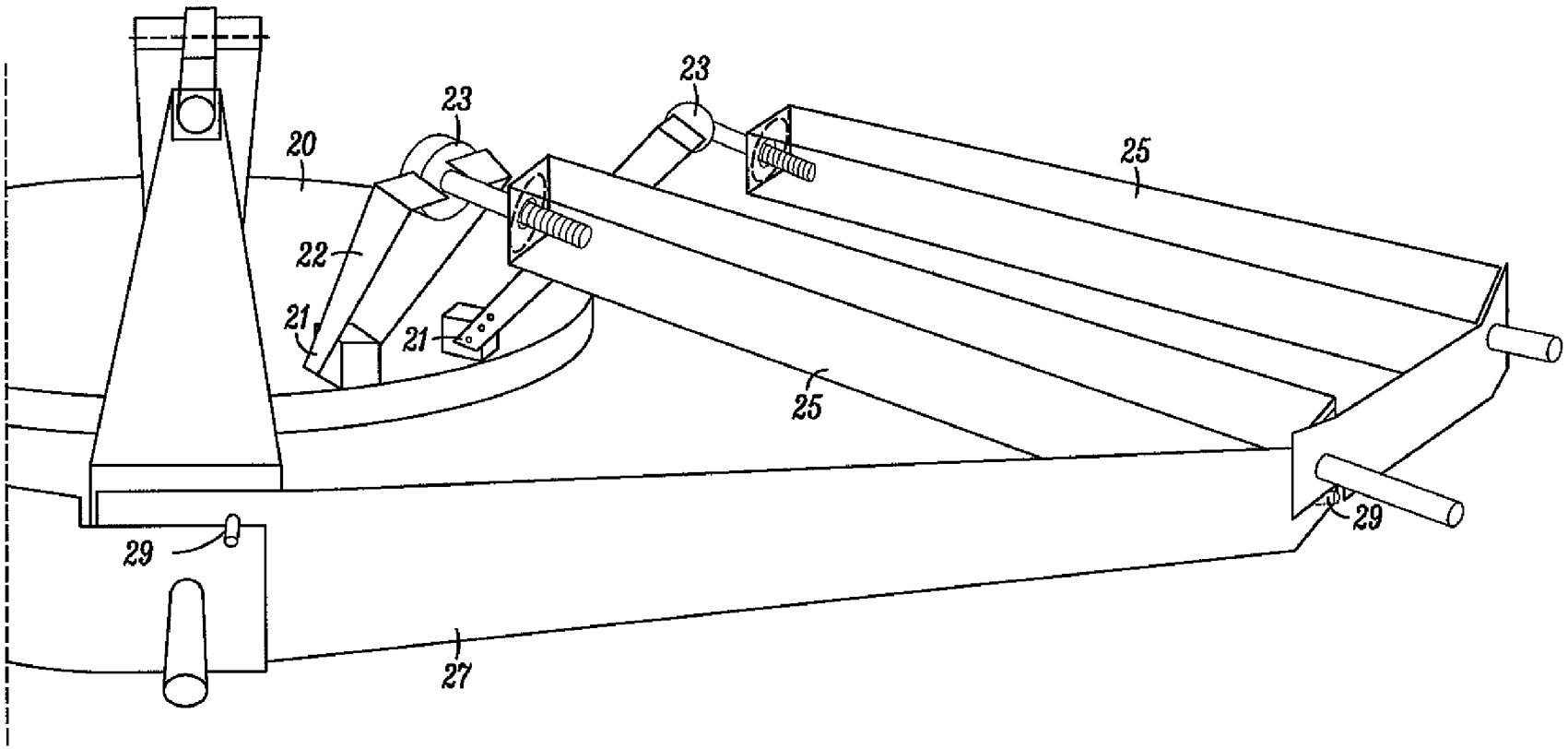
FIG. 7 is a partial view of the lower arms and upper arms attached to the outer hinge.
Figure 8:
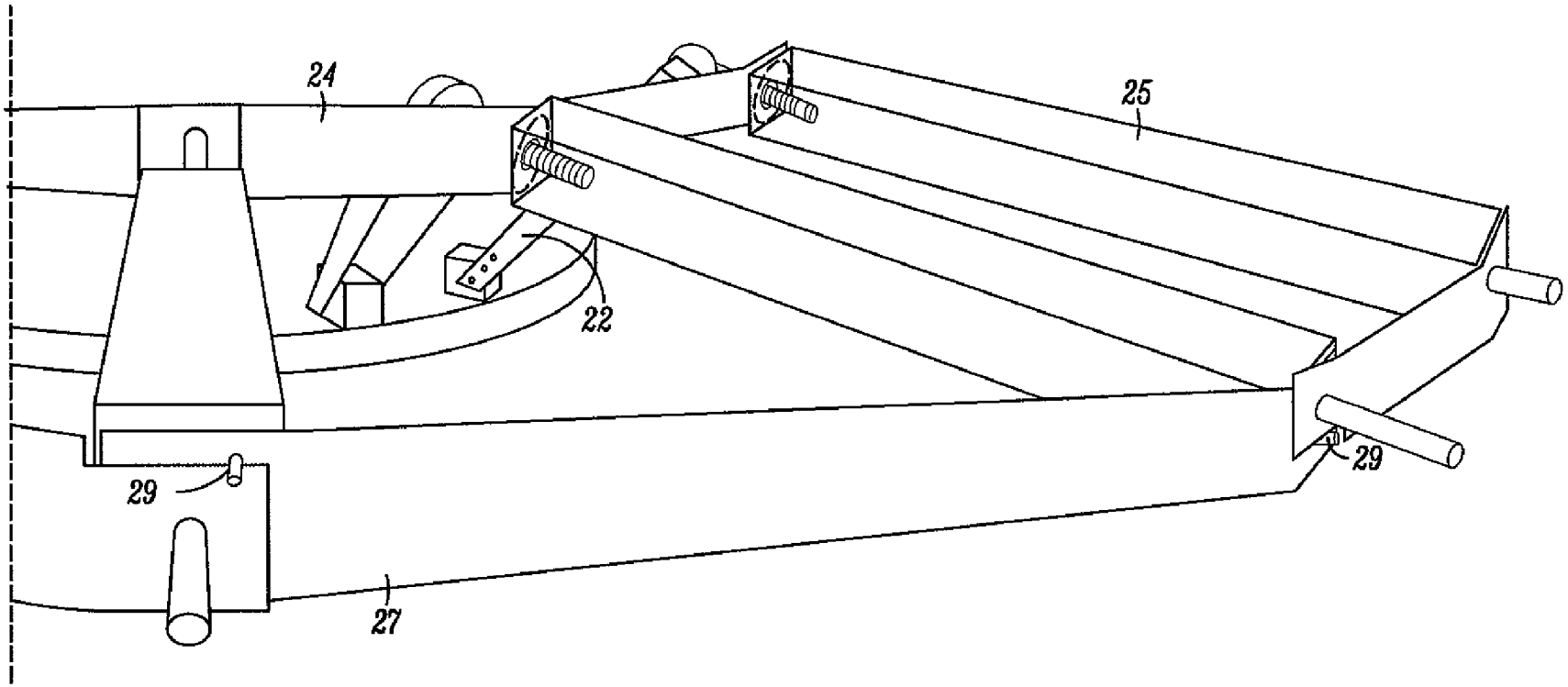
FIG. 8 is a partial view of the outer and inner hinges attached to the upper arms.

Referring now to FIG. 7 the section of the lifting portion 20 is illustrated with the lower arms 22 attached to the upper arms 25 through the joints 23. The lower arms 22 are attached to the perimeter of the lifting portion 20 with joints 21. The joints 21 move up and down and can not move in any other direction. Therefore lower arms 22 can move only in two directions: folding toward the center of the lifting portions during the folding motion and extending outward from the lifting portion during the unfolding motion. The joints 23 have two motions: one motion is an upward and downward motion in the attachment of the joints 23 to the lower arms 22 and the second motion is the rotational motion in the point of attachment of the screws 32 to the upper arms 25. The rotational motion is the motion of the inner hinge 24 which is illustrated in FIG. 8. The restricting pins 29 of the outer hinge may be located on the outer side of the outer hinge as well as in the inner side of the outer hinge as it is illustrated in FIGS. 5 and 6.

Figure 9:
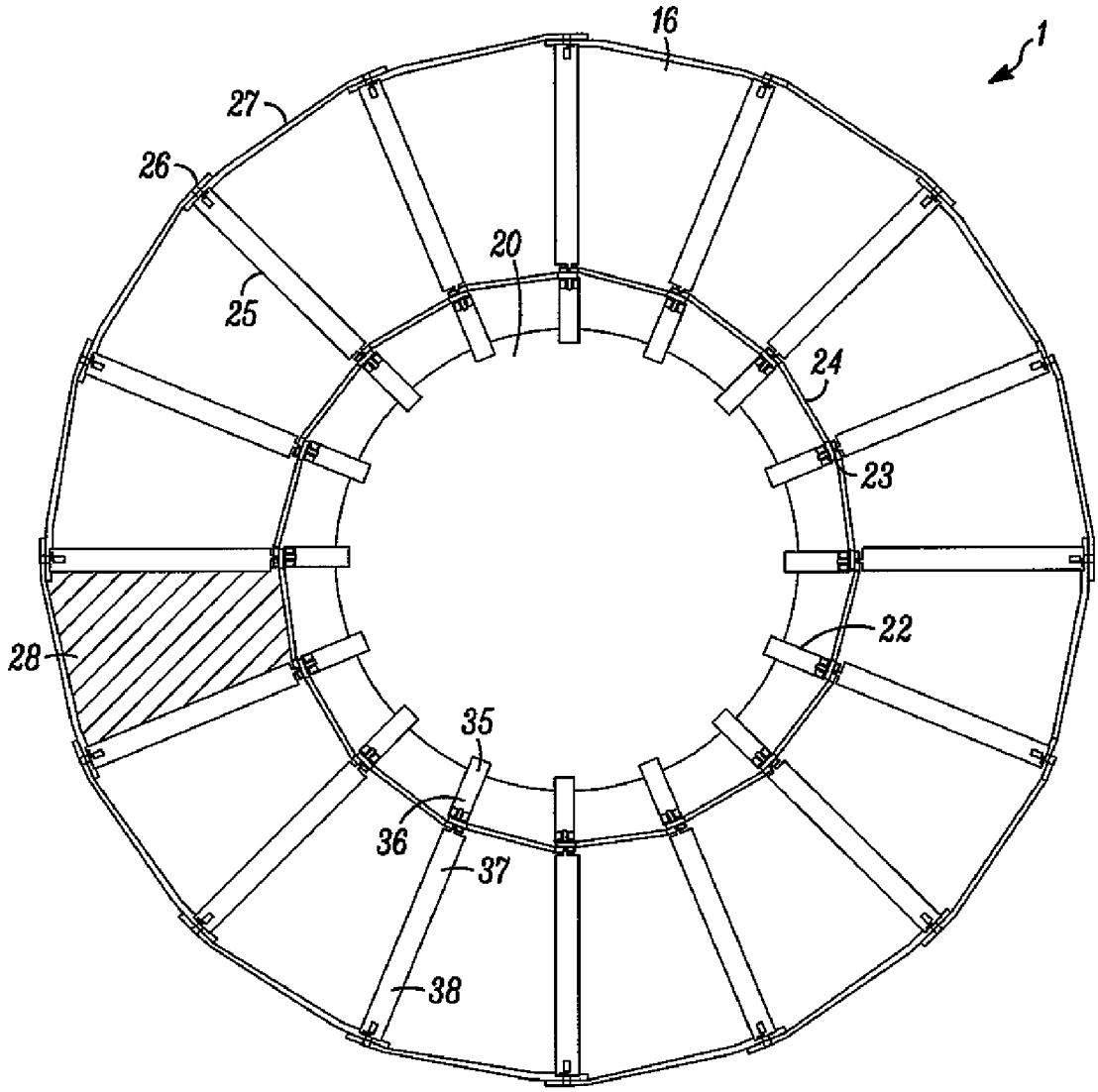
FIG. 9 is a top view of the foldable table top in a fully opened position.

Referring now to FIG. 9 the table top 1 is illustrated in its fully opened position with the lifting portion 20 in the center with joints 21 connected to the perimeter of the plate attached to the lower arms 22 attached to the joints 23 which are further attached to the upper arms 25 and extending through the hinge joints 26 to the outer hinge 27. It is also easy to see that the lower arm 22 has a first end 35 and the second end 36 while the upper arm 25 has a first end 37 and the second end 38. Further the top plates 28 are attached to the outer hinge 27 and to the inner hinge 24 between the upper arms 25. The top plates 28 may be manufactured from durable polymers, wood, fiber glass, glass, plastics or metal. Thin sheets of metal such as aluminum are preferable but durable polymers can be used as well. The top plates 28 are attached between the upper arms 25, the inner hinge 24 and the outer hinge 27.

During the folding operation the top table plates 28 are folded toward each other during the folding operation of the jack unit 13 and contained inside the table base 2.

Figure 10:
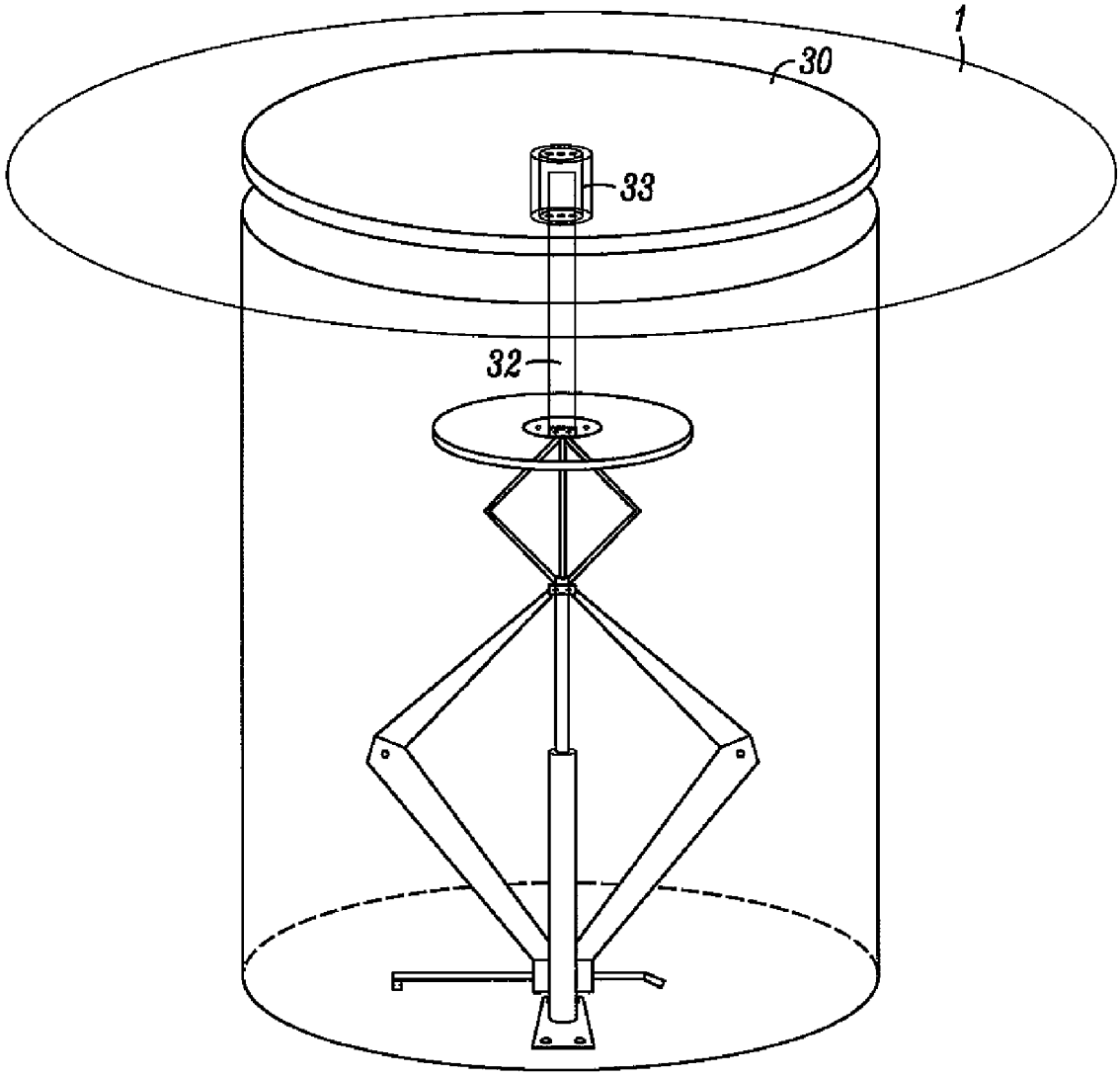
FIG. 10 is side elevation view of the folded table in a fully open operable position covered with the lid.

FIG. 10 further illustrates the fully opened folding table assembly with the lid 30 lying on the top of the rod 32 attached to the center of the lifting portion. In this embodiment the lid 30 may easily rotate on the rod 32 in the motion of the "Lazy Susan". A "Lazy Susan" is a part of the table which may rotate and assist users around the table to transfer food and cutlery from one side of the table to another just by placing it on the surface of the "Lazy Susan" and rotating it toward the person requiring the item. The designs of the "Lazy Susan" are well known to one skilled in the art and may be manufactured in different ways with different locations of the rotational devices while the lid 30 may be manufactured in the simplest way without the rotational motion of the "Lazy Susan".

Figure 11:
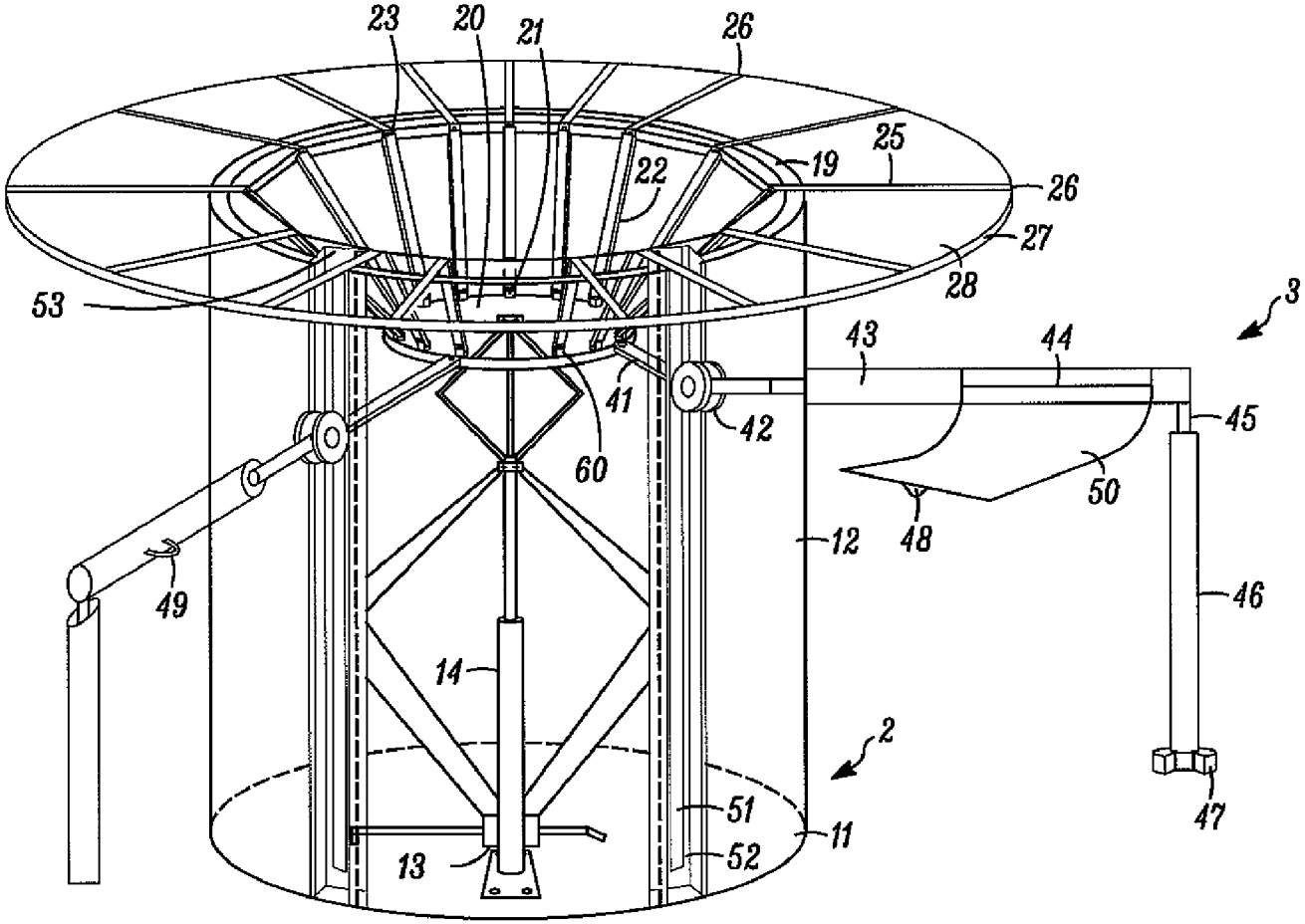
FIG. 11 is a side view of a variant of the foldable table with a foldable seat attachment.

FIG. 11 illustrates another embodiment of the invention. In this embodiment the folding table assembly further comprises a foldable seat assembly 3 which is attached to the lifting portion 20 with a rib 41 and therefore moves together with the lifting portion by the operation of the jack unit 13. The core of the seat assembly is made of a hip 43 and a leg 46 attached by a knee joint 45. The leg 46 stands on the ground with its foot 47 and the user sits on the seat 50 which extends between the hips 43 located on the adjacent seat. The seat 50 is made of fabric which may be accumulated into a seat tube 44 or in the operational position this fabric is extended from the seat tube 44 and attached to the attachment part 49 of the adjacent hip of the adjacent seat assembly. The attachment of the seat fabric 50 to the attachment part 49 is made by the attachment member 48. The members 48 and 49 are designed to be easily attached together and keep those attachments during the term of the usage of the seat assembly until the user decides to disassemble the seat assembly by detaching the parts 48 and 49. The attachments 48 and 49 may be of any type of attachments known in the art such as loops and hooks or any other types of attachments. There has to be at least one loop and hook device while in the preferred embodiment there are more loops and hooks 48 and 49 to attach the fabric of seat 50 between the hip of the adjacent seat assembly. The fabric of seat 50 may be made of any fabric available on the market stong enough to support the weight of a person. It can be made of polyester, polymer, strong fabric material or synthetic, rubberized, perforated for ventilation or made of any other seat material suitable for this utility. The hip 43 is attached to the rib 41 with the hip joint 42 which can slide through the sliding slot 51 of the table base 2.

Figure 12:
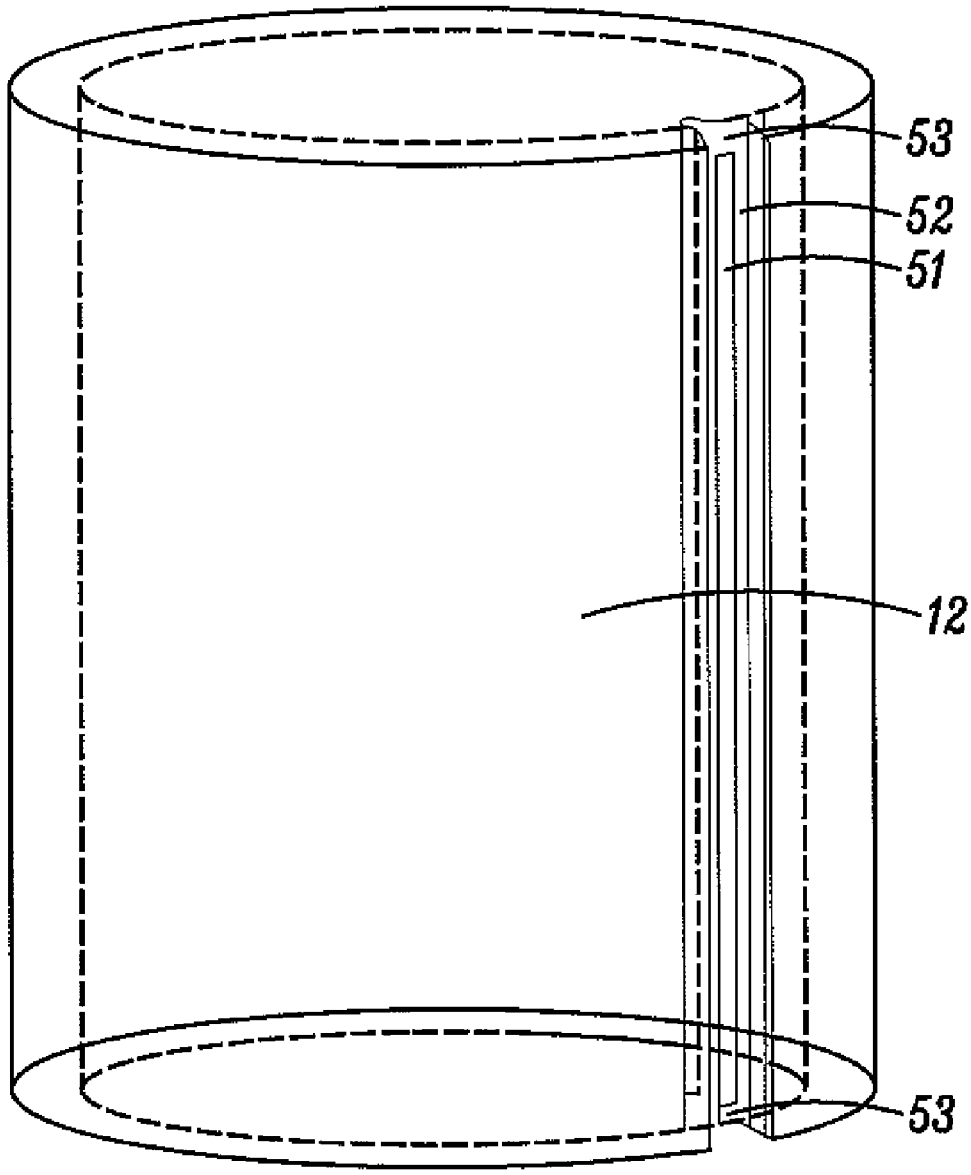
FIG. 12 is a side view of the table base of a variant of the invention with the foldable seats.

Referring now to FIG. 12 there is a table base illustrated in relation to the second embodiment of the invention. It shows a profile 52 with a sliding slot 51 attached to the table base. This profile and the slot are attached to the table base 205, with each seat assembly through the perimeter of the table base. The profile 52 is made of a strong material preferably metal and securely attached to the table base 2 specifically to the hollow pillar 12. The cut out 51 provides the sliding slot for the hip joint cut through the profile 52 leaving top and bottom parts 53 of the profile 52 to maintain the rigidity of the table base.

Figure 13:
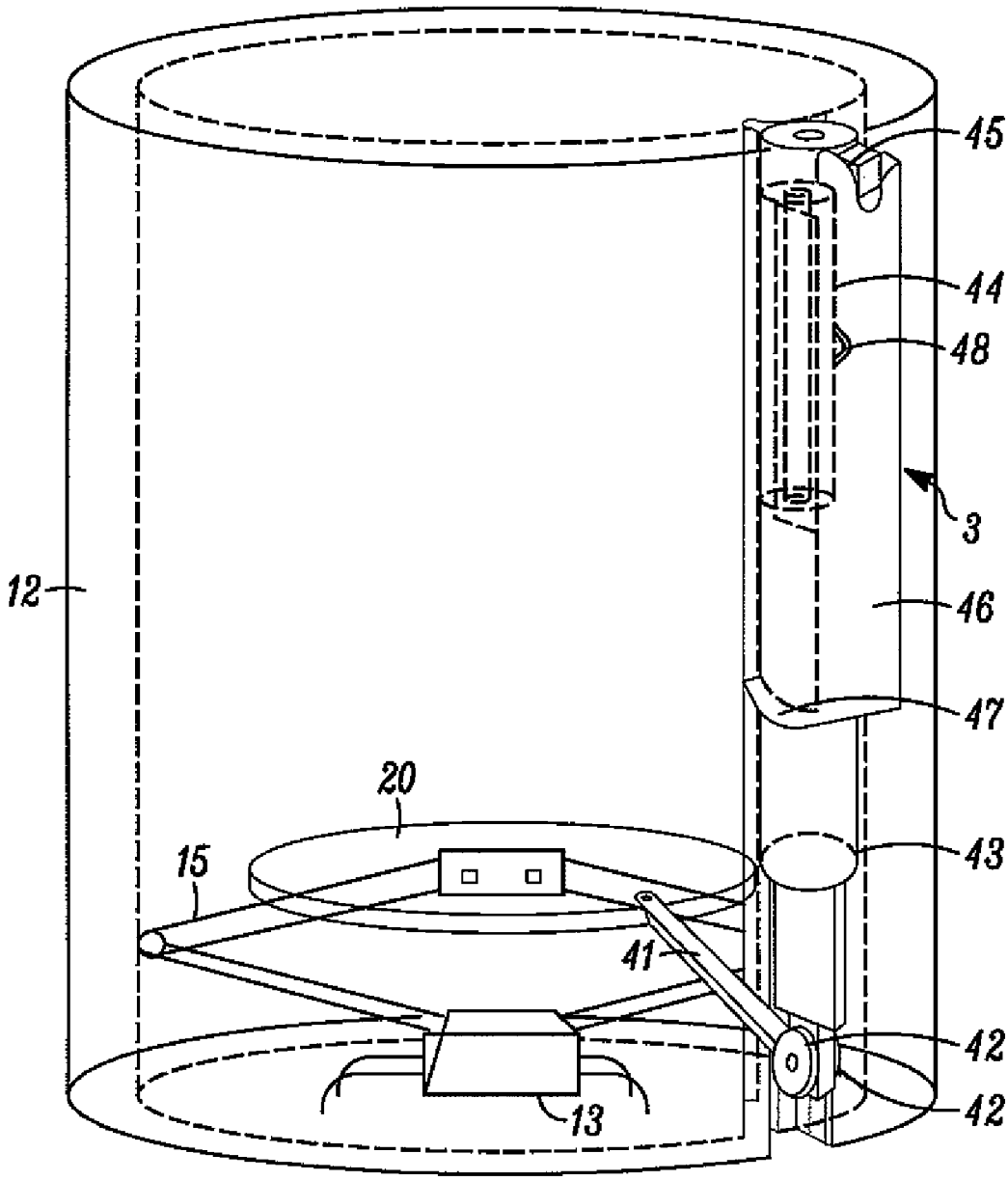
FIG. 13 is a side view of one of the foldable seats folded into its fully closed position.

Referring now to FIG. 13 for ease of understanding only one seat assembly is illustrated. But it is understood that there are several seat assemblies through the perimeter of the table base. FIG. 13 illustrates the attachment of the folding seat assembly to the lifting portion 20 and it shows the location and position of the seat assembly during the storage phase of the folding table set.

Figure 14:
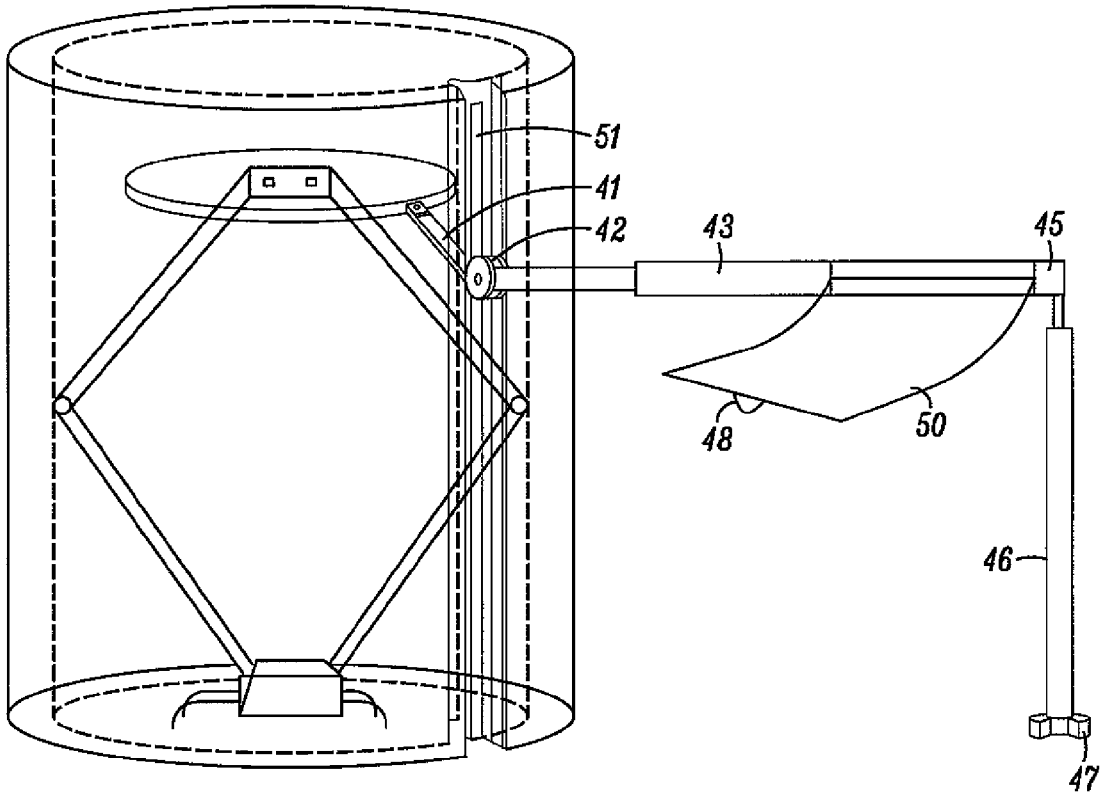
FIG. 14 is a side view of the foldable seat in its fully opened position.
Figure 15:
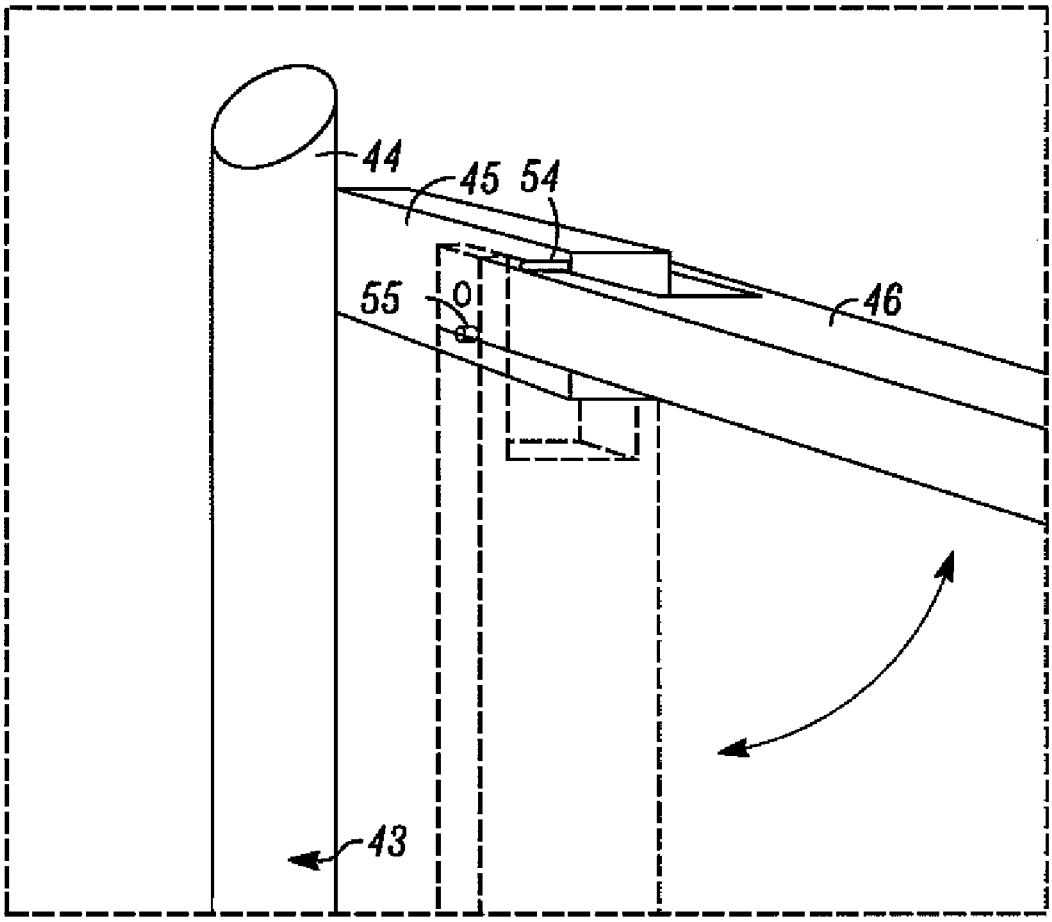
FIG. 15 is a close-up of the knee joint of the foldable seat.

FIG. 14 illustrates the folding seat assembly in its unfolded position attached at one end to the lifting portion with a rib, hip joint and hip of the leg extending perpendicular to the hip 43 with the foot 47 resting on the ground. In order to prevent unwanted collapse of the seat assembly the knee joint 45 has a safety device the spring pin 55. This safety feature is illustrated in FIG. 15. When the seat assembly is in its fully unfolded position the spring pin 55 prevents the leg 46 from folding toward the hip 43. In order to fold the seat assembly into its storage position the spring pin 55 has to be pressed and then leg 46 can be bent toward the hip 43.

There are also several safety features in this folding table and seat assembly. The jack has an upper and lower limits in order to prevent over extension and destruction of the table. The construction and the parts of the table are very rigid and simple. The folding seat assembly has its own safety features as illustrated on FIG. 15, this way the seat assembly can not collapse by itself under the weight of the user.

In order to operate the first embodiment of the invention which includes only the folding table assembly the user has to remove the lid 30 and then press the button of a remote or local control of the table and wait until the jack unfolds the table top from the table base and then position the lid 30 in the middle of the table top. If the table top assembly is equipped with the rod 32, the lid 30 has to be positioned on the rod 32 with the socket 33 and will be used as a "Lazy Susan" during the utilization of the unfolded table. In order to fold the table for storage, the lid 30 needs to be removed from its position and the operating button of the jack pressed again. Then the user needs to wait until the jack unit 13 folds the table top into the perimeter of the hollow pillar and then position the lid 30 on the top of rim 19 of the table base and store the table for the next usage. The covered pillar can be used as a night stand, as a coffee table or for any other decorative or utility usage.

The second embodiment of the invention, the one that includes the foldable seat assembly requires more operation from the user. The first part for unfolding the table is the same as in the first embodiment, the user has to remove the lid 30, press the button of the remote or local control of the jack unit 13, wait until the table top unfolds from the interior of the hollow pillar, during the movement of the lifting portion the rib 42 pushing the hip joint 42 upward. By this motion the hip 43 is removed from its holding position inside the table base and move toward the position illustrated in FIG. 14. Then the user has to pull the leg portions 36 in order to lock spring pins 55 into the safety position to prevent the collapsing of the seating unit for every seat assembly around the table base. The user then has to pull the fabric of the seat 50 from the roller 44 located on the hips 43 of the seat assembly 3 and attach them to the attachment parts 48 and 49 of the proximate hips of the seat assembly. After the usage of the folding seat assembly and folding table the user has to disengage the attachment parts 48 and 49 of the seat 50 from the corresponding attachments parts on the proximate hips of each seat assembly, then the user has to disengage the spring pin 55 in order to fold the leg 46 of the seat assembly toward the hip 43. Then the user has to press the button for operating the jack unit 13, after removing the lid 30 from the top of the table. The jack unit 13 brings the table top into the interior of the table base and finally the user has to lock the leg portion of the seat assembly into the corresponding location around the perimeter of the table base finally placing the lid 30 on top of the table base on the rim 19.

Various improvements can be made to the folding table assembly. One of the improvements may be the attachment of small wheels onto the bottom of the table base, this will ease the movement of the table assembly from one part of the room to another for cleaning purposes. Another improvement may be a detachable electrical cord of the jack assembly which can be detached after the extension of the table and then removed and reattached in order to fold the table for storage.

As many changes can be made to the preferred embodiments of the invention without departing from the scope thereof. It is intended that all matter contained herein be considered illustrative of the invention and not it a limiting sense The embodiments of the invention in which an exclusive property or privilege is claimed are as follows:

1. A folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior, wherein operation of the jack permits the folding and unfolding of the table, wherein said jack is electrically operable and capable of moving upward and downward with a local or remote control to move said folding table between the folded and unfolded positions further comprising the folding table is substantially round at the unfolded position, and comprising:

a lifting portion, engaged with said jack and having a plurality of lower arms, each arm having a first end and a second end, the first end of each lower arm being attached to the lifting portion allowing the lower arm to move substantially vertically;

a plurality of upper arms in association with said plurality of lower arms, each upper arm having a first end and a second end, the first end of the upper arm being connected to the second end of the lower arm and is able to move substantially vertically;

outer hinges connecting the second ends of the upper arms and capable of movement at the connection points;

inner hinges connecting the second ends of the lower arms and capable of movement at the connection points; and table top members extending between the outer hinges, the inner hinges and the two respective adjacent upper arms, thus forming a table top at the unfolded position.

2. The assembly of the claim 1 wherein the folding table folds in upon itself in a fan like orientation, wherein operation of the jack permits the folding and unfolding of the table.

3. The assembly of claim 1 further comprising a folding seat moveable between a folded and an unfolded position at least partially operable by the operation of the jack.

4. The assembly of claim 3 wherein the folding seat further comprises:

a beam, a post for supporting the beam at a substantially horizontal position and, a seating member extending between adjacent beams of the foldable seat assembly at the fully open position;

wherein at the folded position the post is folded toward the beam and the beam being moved by the jack toward the wall of the base and thereat locking the beam and the post in the position preferably parallel to the wall.

5. The assembly of claim 4 wherein the beam further comprises a container which contains the seating member in a biased state.

6. The assembly of claim 5 wherein each beam and seating member comprises an interlocking member which engage and disengage when the folding seat is moved between the folded and unfolded positions.

7. The assembly of claim 1 further comprising a lid suitable for covering the wall and the hollow interior of the base the lifting portion comprising a rod member rotatably connected to the lid at one end and the lid suitable to rotate on top of the rod member in the operational mode of the assembly.

8. A folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior, wherein operation of the jack permits the folding and unfolding of the table, wherein said jack is preferably a scissors jack preferably electrical and capable of moving upward and downward preferably with a local or remote control to move said folding table between the folded and unfolded positions, further comprising a folding table that is substantially round at the unfolded position, and comprising:

a lifting portion, engaged with said jack and having a plurality of lower arms, each arm having a first end and a second end, the first end of each lower arm being attached to the lifting portion allowing the lower arm to move substantially vertically;

a plurality of upper arms in association with said plurality of lower arms, each upper arm having a first end and a second end, the first end of the upper arm being connected to the second end of the lower arm and is able to move substantially vertically;

outer hinges connecting the second ends of the upper arms and capable of movement at the connection points;

inner hinges connecting the second ends of the lower arms and capable of movement at the connection points; and table top members extending between the outer hinges, the inner hinges and the two respective adjacent upper arms, thus forming a table top at the unfolded position.

9. The assembly of claim 8 wherein the beam further comprises a container which contains the support member in a biased state.

10. The assembly of claim 9 wherein each beam and seating member comprises an interlocking member which engage and disengage when the folding seat is moved between the folded and unfolded positions.

11. The assembly of claim 8 further comprising a lid suitable for covering the wall and the hollow interior of the base.

12. The assembly of claim 11 further comprising a lifting portion comprising a rod member and the lid suitable to rotate on top of the rod member in the operational mode of the assembly.

13. A folding table assembly comprising a base including a wall surrounding a hollow interior for containing a folding table, the folding table moveable between a folded and an unfolded position and a jack moving the folding table between the folded position inside the hollow interior of said base and an unfolded preferably substantially horizontal position removed from the hollow interior, wherein operation of the jack permits the folding and unfolding of the table, wherein said jack is preferably a scissors jack preferably electrical and capable of moving upward and downward preferably with a local or remote control to move said folding table between the folded and unfolded positions, further comprising a folding table that is substantially round at the unfolded position, and comprising:

a lifting portion, engaged with said jack and having a plurality of lower arms, each arm having a first end and a second end, the first end of each lower arm being attached to the lifting portion allowing the lower arm to move substantially vertically;

a plurality of upper arms in association with said plurality of lower arms, each upper arm having a first end and a second end, the first end of the upper arm being connected to the second end of the lower arm and is able to move substantially vertically;

outer hinges connecting the second ends of the upper arms and capable of movement at the connection points;

inner hinges connecting the second ends of the lower arms and capable of movement at the connection points; and table top members extending between the outer hinges, the inner hinges and the two respective adjacent upper arms, thus forming a table top at the unfolded position;

said folding table assembly further comprises a folding seat moveable between a folded and an unfolded position at least partially operable by the operation of the jack, the folding seat comprising:

a beam, a post for supporting the beam at a substantially horizontal position and, a seating member extending between adjacent beams of the foldable seat assembly at the fully open position;

wherein at the folded position the post is folded toward the beam and the beam being moved by the jack toward the wall of the base and thereat locking the beam and the post in the position preferably parallel to the wall.

14. The assembly of claim 13 wherein the beam further comprises a container which contains the support member in a biased state.

15. The assembly of claim 14 wherein each beam and seating member comprises an interlocking member which engage and disengage when the folding seat is moved between the folded and unfolded positions.

16. The assembly of claim 13 further comprising a lid suitable for covering the wall and the hollow interior of the base.

17. The assembly of claim 16 further comprising a lid suitable for covering the wall and the hollow interior of the base a lifting portion comprising a rod member rotatably connected at one end to the lid and the lid suitable to rotate on top of the rod member in the operational mode of the assembly.

* * * * *